US010180056B2

(12) United States Patent
Mashetty et al.

(10) Patent No.: US 10,180,056 B2
(45) Date of Patent: Jan. 15, 2019

(54) SYSTEMS AND METHODS FOR ACQUIRING GENERATING WATERCUT AND BOTTLENECK NOTIFICATIONS AT A WELL SITE

(71) Applicant: ROCKWELL AUTOMATION ASIA PACIFIC BUSINESS CENTER PTE. LTD., Singapore (SG)

(72) Inventors: Srikanth G. Mashetty, Houston, TX (US); Miguel Armando Machado, Villahermosa (MX)

(73) Assignee: ROCKWELL AUTOMATION ASIA PACIFIC BUSINESS CENTER PTE. LTD., Singapore (SG)

( * ) Notice: Subject to any disclaimer, the term of this patent is extended or adjusted under 35 U.S.C. 154(b) by 377 days.

(21) Appl. No.: 14/927,335

(22) Filed: Oct. 29, 2015

(65) Prior Publication Data

US 2017/0122100 A1 May 4, 2017

(51) Int. Cl.
*E21B 43/34* (2006.01)
*E21B 43/12* (2006.01)

(52) U.S. Cl.
CPC ..... *E21B 43/34* (2013.01); *E21B 43/12* (2013.01)

(58) Field of Classification Search
None
See application file for complete search history.

(56) References Cited

U.S. PATENT DOCUMENTS 7,096,092 B1 * 8/2006 Ramakrishnan ..... E21B 43/00 340/853.1
2012/0118077 A1 * 5/2012 Henry ..... G01F 1/74 73/861.354
2016/0245074 A1 * 8/2016 Schollenberger ..... E21B 47/10

* cited by examiner

*Primary Examiner* — Nay Tun
*Assistant Examiner* — Shawna M Kingston
(74) *Attorney, Agent, or Firm* — Fletcher Yoder P.C.

(57) ABSTRACT

A system may include a monitoring device that may receive data associated with one or more properties of a well. The well may produce a flow of hydrocarbons. The monitoring device may receive data associated with the well and determine whether the flow of hydrocarbons includes a percentage of water greater than a threshold based on whether the data is outside a profile associated with the flow of hydrocarbons at the well over time. The monitoring device may then send an alarm notification to another device indicating an increased water cut in the flow of hydrocarbon.

9 Claims, 6 Drawing Sheets

SYSTEMS AND METHODS FOR ACQUIRING GENERATING WATERCUT AND BOTTLENECK NOTIFICATIONS AT A WELL SITE

BACKGROUND

The present disclosure relates generally to monitoring various properties at a hydrocarbon well site. More specifically, the present disclosure relates to providing a local system for monitoring the various phases of solids, liquids, and gasses that are part of a flow of hydrocarbons being extracted from the hydrocarbon well site.

As hydrocarbons are extracted from hydrocarbon reservoirs via hydrocarbon wells in oil and/or gas fields, the extracted hydrocarbons may be transported to various types of equipment, tanks, and the like via a network of pipelines. For example, the hydrocarbons may be extracted from the reservoirs via the hydrocarbon wells and may then be transported, via the network of pipelines, from the wells to various processing stations that may perform various phases of hydrocarbon processing to make the produced hydrocarbons available for use or transport.

Information related to the extracted hydrocarbons or related to the equipment transporting, storing, or processing the extracted hydrocarbons may be gathered at the well site or at various locations along the network of pipelines. This information or data may be used to ensure that the well site or pipelines are operating safely and that the extracted hydrocarbons have certain desired qualities (e.g., flow rate, temperature). The data related to the extracted hydrocarbons may be acquired using monitoring devices that may include sensors that acquire the data and transmitters that transmit the data to computing devices, routers, other monitoring devices, and the like, such that well site personnel and/or off-site personnel may view and analyze the data.

Generally, the data available to well site personnel may not have access to certain information in real time or near real time at the well site. As such, the well site personnel may be limited with regard to controlling, analyzing, or optimizing the hydrocarbon production at a well site. That is, to optimize hydrocarbon production at the well site, well site personnel should quickly analyze data available at the well site and make decisions regarding the operations at the well site based on the analysis of the data. However, the data available at the well site often may not include certain information that may enable the well site personnel to make decisions regarding the operations at the well site. Accordingly, it is now recognized that improved systems and methods for providing additional information regarding various properties regarding a hydrocarbon well site at the hydrocarbon well site are desirable.

BRIEF DESCRIPTION

In one embodiment, a system may include a monitoring device that may receive data associated with one or more properties of a well. The well may produce a flow of hydrocarbons. The monitoring device may receive data associated with the well and determine whether the flow of hydrocarbons includes a percentage of water greater than a threshold based on whether the data is outside a profile associated with the flow of hydrocarbons at the well over time. The monitoring device may then send an alarm notification to another device indicating an increased water cut in the flow of hydrocarbon.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
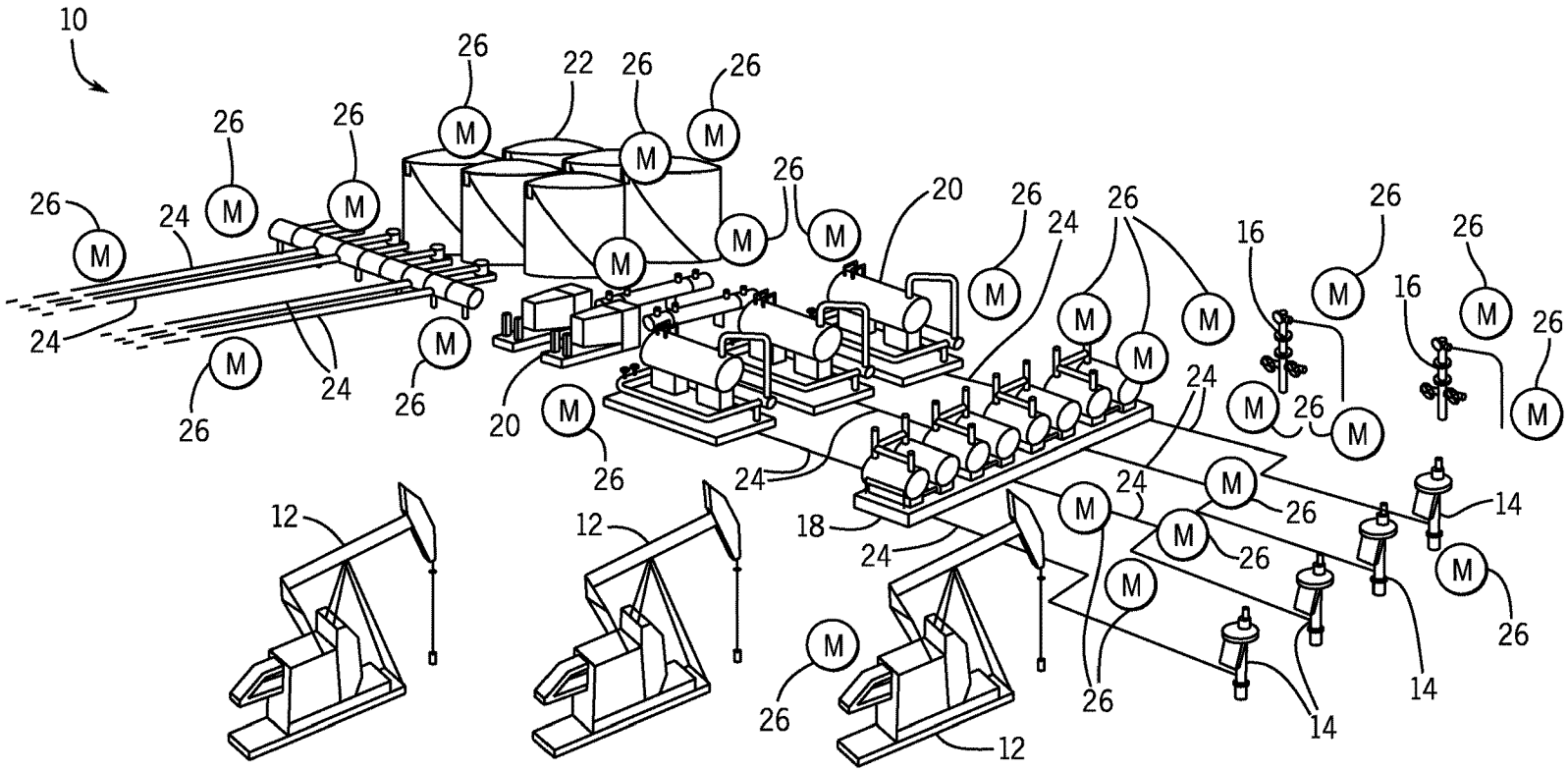
FIG. 1 illustrates a schematic diagram of an example hydrocarbon site that may produce and process hydrocarbons, in accordance with embodiments presented herein.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure are generally directed towards improved systems and methods for providing hydrocarbon production analysis data at a hydrocarbon well site in real time or near real time. Moreover, embodiments of the present disclosure are related to improved systems and methods for determining multiphase measurements or properties of hydrocarbons being produced at the hydrocarbon well site based on data received at real time or near real time.

Hydrocarbon production generally produces oil, water, gas, and sand together. Each of these items is commonly known a phase of the production. By knowing the content or amount of water, oil (e.g., hydrocarbon), and gas or water, oil, gas, and sand in production fluids, an operator may better understand the properties of the reservoir from which the production fluids are being extracted. Moreover, the operator may adjust various control measures (e.g., pressure, flow) at a well site where the hydrocarbons are being produced.

In some cases, the phases of the production fluids are physically separated using a separator and then measured to determine the multiphase composition of the hydrocarbons being produced. In one embodiment, a monitoring system located at a wellhead, in a remote terminal unit (RTU) may determine the amount of each phase in the production fluids while the production fluids are being extracted or flowing at the well site. The monitoring system may determine these phase measurements based on a hydrocarbon model that estimates the multiphase properties of the flow of hydrocarbons (e.g., oil, water, gas, sand) based on physical properties of the hydrocarbons being extracted and certain data available at the well site. The hydrocarbon model may provide information regarding flow properties of various hydrocarbon fluids being produced at a well site based on surface characteristics at the well site. For instance, the hydrocarbon model may provide real-time or near real-time estimates of at least one phase of oil, water, and gas production at a well site based on predetermined well characteristics (e.g., well completion data, such as depth, type of pipe; reservoir data, such as free static pressure; and pressure-volume-temperature (PVT) sets/assays from the same or a nearby well), and dynamically measured data (e.g., pressure and temperature data at the well site). After estimating the multiphase properties being produced at the well site, the monitoring system may send a notification to a computing device (e.g., tablet computer) being used by the operator, display the properties via a display, perform some control action on various components (e.g., send close valve command to valve), and so forth based on the multiphase properties being produced. By determining the multiphase properties of the hydrocarbons being produced at the well site, the monitoring system may adjust the production parameters at the well site to more efficiently produce hydrocarbons. Additional details regarding estimating the multiphase properties at the well site will be discussed below with reference to FIGS. 1-7.

By way of introduction, FIG. 1 illustrates a schematic diagram of an example hydrocarbon site 10. The hydrocarbon site 10 may be an area in which hydrocarbons, such as crude oil and natural gas, may be extracted from the ground, processed, and stored. As such, the hydrocarbon site 10 may include a number of wells and a number of well devices that may control the flow of hydrocarbons being extracted from the wells. In one embodiment, the well devices in the hydrocarbon site 10 may include pumpjacks 12, submersible pumps 14, well trees 16, and the like. After the hydrocarbons are extracted from the surface via the well devices, the extracted hydrocarbons may be distributed to other devices such as wellhead distribution manifolds 18, separators 20, storage tanks 22, and the like. At the hydrocarbon site 10, the pumpjacks 12, submersible pumps 14, well trees 16, wellhead distribution manifolds 18, separators 20, and storage tanks 22 may be connected together via a network of pipelines 24. As such, hydrocarbons extracted from a reservoir may be transported to various locations at the hydrocarbon site 10 via the network of pipelines 24.

The pumpjack 12 may mechanically lift hydrocarbons (e.g., oil) out of a well when a bottom hole pressure of the well is not sufficient to extract the hydrocarbons to the surface. The submersible pump 14 may be an assembly that may be submerged in a hydrocarbon liquid that may be pumped. As such, the submersible pump 14 may include a hermetically sealed motor, such that liquids may not penetrate the seal into the motor. Further, the hermetically sealed motor may push hydrocarbons from underground areas or the reservoir to the surface.

The well trees 16 or Christmas trees may be an assembly of valves, spools, and fittings used for natural flowing wells. As such, the well trees 16 may be used for an oil well, gas well, water injection well, water disposal well, gas injection well, condensate well, and the like. The wellhead distribution manifolds 18 may collect the hydrocarbons that may have been extracted by the pumpjacks 12, the submersible pumps 14, and the well trees 16, such that the collected hydrocarbons may be routed to various hydrocarbon processing or storage areas in the hydrocarbon site 10.

The separator 20 may include a pressure vessel that may separate well fluids produced from oil and gas wells into separate gas and liquid components for the produced oil, water, gas, or sand. For example, the separator 20 may separate hydrocarbons extracted by the pumpjacks 12, the submersible pumps 14, or the well trees 16 into oil components, gas components, and water components. After the hydrocarbons have been separated, each separated component may be stored in a particular storage tank 22. The hydrocarbons stored in the storage tanks 22 may be transported via the pipelines 24 to transport vehicles, refineries, and the like.

Although the separator 20 may provide information regarding the different phases of the hydrocarbons being produced at a well site, separating the hydrocarbons into the different components may take some time. Moreover, since the separator 20 is located away from the well site or a well head where the hydrocarbons are being produced from the ground, data regarding the multiphase properties of the produced hydrocarbons may not be available at the well site where the operator may adjust various parameters related to the production of the hydrocarbons based on the multiphase properties of the produced hydrocarbons.

The hydrocarbon site 10 may also include monitoring systems 26 that may be placed at various locations in the hydrocarbon site 10 to monitor or provide information related to certain aspects (e.g., multiphase properties) of the hydrocarbon site 10. As such, the monitoring system 26 may be a controller, a remote terminal unit (RTU), or any computing device that may include communication abilities, processing abilities, and the like. The monitoring system 26 may include sensors or may be coupled to various sensors that may monitor various properties associated with a component at the hydrocarbon site 10. The monitoring system 26 may then analyze the various properties associated with the component and may control various operational parameters of the component. For example, the monitoring system 26 may measure a pressure or a differential pressure of a well or a component (e.g., storage tank 22) in the hydrocarbon site 10. The monitoring system 26 may also measure a temperature of contents stored inside a component in the hydrocarbon site 10, an amount of hydrocarbons being processed or extracted by components in the hydrocarbon site 10, and the like. The monitoring system 26 may also measure a level or amount of hydrocarbons stored in a component, such as the storage tank 22. In certain embodiment, the monitoring systems 26 may be iSens-GP Pressure Transmitter, iSens-DP Differential Pressure Transmitter, iSens-MV Multivariable Transmitter, iSens-T2 Temperature Transmitter, iSens-L Level Transmitter, or Isens-IO Flexible I/O Transmitter manufactured by vMonitor® or Rockwell Automation®.

In one embodiment, the monitoring system 26 may include a sensor that may measure pressure, temperature, fill level, flow rates, and the like. The monitoring system 26 may also include a transmitter, such as a radio wave transmitter, that may transmit data acquired by the sensor via an antenna or the like. In one embodiment, the sensor in the monitoring system 26 may be wireless sensors that may be capable of receive and sending data signals between monitoring systems 26. To power the sensors and the transmitters, the monitoring system 26 may include a battery or may be coupled to a continuous power supply. Since the monitoring system 26 may be installed in harsh outdoor and/or explosion-hazardous environments, the monitoring system 26 may be enclosed in an explosion-proof container that may meet certain standards established by the National Electrical Manufacturer Association (NEMA) and the like.

The monitoring system 26 may transmit data acquired by the sensor or data processed by a processor to other monitoring systems, a router device, a supervisory control and data acquisition (SCADA) device, or the like. As such, the monitoring system 26 may enable users to monitor various properties of various components in the hydrocarbon site without being physically located near the corresponding components.

Figure 2:
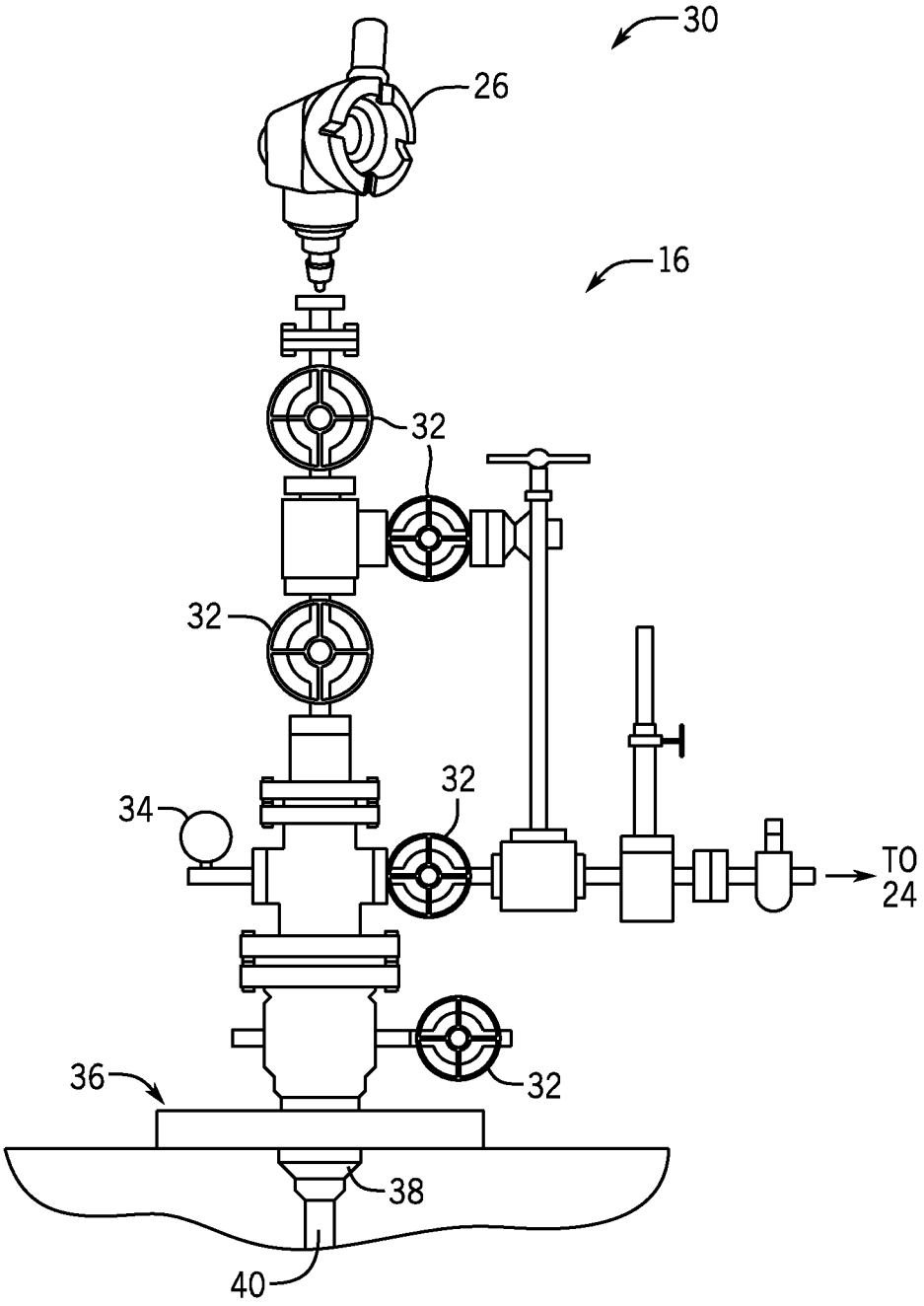
FIG. 2 illustrates a front view of an example well-monitoring system used in the hydrocarbon site of FIG. 1, in accordance with embodiments presented herein.

Keeping the foregoing in mind, FIG. 2 illustrates an example of a well-monitoring system 30 that includes the monitoring system 26 and the well tree 16. Although the well-monitoring system 30 is illustrated as the monitoring system 26 coupled to the well tree 16, it should be noted that the monitoring system 26 may be coupled to any well device or may be coupled to another free-standing structure.

Referring now to FIG. 2, the well tree 16 may include a number of valves 32 that may control the flow of the extracted hydrocarbons to the network of pipelines 24 and the like. The well tree 16 may also include various gauges 34 that may receive information related to the pressure, temperature, flow, and other attributes associated with the well tree 16. A portion of the well tree 16 that meets the surface of the Earth may correspond to a wellhead 36. The wellhead 36 may be coupled to a casing 38 and a tubing 40. Generally, the wellhead 36 may include various components and structures to support the casing 38 and the tubing 40 being routed into a borehole of the well. Moreover, the wellhead 36 also provides a structure at which the well tree 16 may be attached to the casing 38 and the tubing 40.

The casing 38 may be a large diameter pipe that is assembled and inserted into a drilled section of a borehole and may be held into place with cement. The tubing 40 may be placed within the casing 38 and may include a tube used in the borehole in which hydrocarbons may be extracted from a reservoir.

In one embodiment, the monitoring system 26 may receive real-time or near real-time data associated with the wellhead 30 such as, for example, tubing head pressure, tubing head temperature, case head pressure, flowline pressure, wellhead pressure, wellhead temperature, and the like. The monitoring system 26 may receive the real-time data from the gauges 34, sensors disposed in the casing 38, sensors disposed in the tubing 40, and the like. In any case, the monitoring system 26 may analyze the real-time data with respect to static data that may be stored in a memory of the monitoring system 26. The static data may include a well depth, a tubing length, a tubing size, a choke size, a reservoir pressure, a bottom hole temperature, well test data, fluid properties of the hydrocarbons being extracted, and the like. The monitoring system 26 may also analyze the real-time data with respect to other data acquired by various types of instruments (e.g., water cut meter, multiphase meter) to determine the multiphase properties of the hydrocarbons being produced at the well site.

Figure 3:
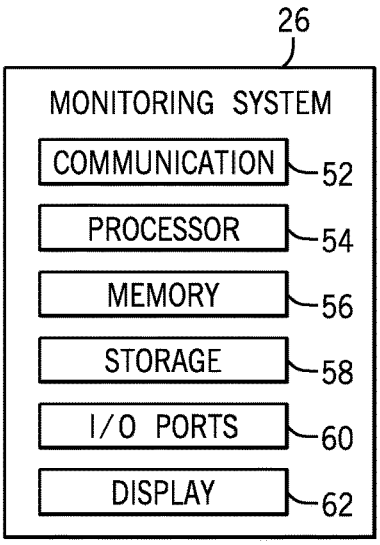
FIG. 3 illustrates a block diagram of a monitoring system that may be employed in the hydrocarbon site of FIG. 1, in accordance with embodiments presented herein.

Keeping this in mind, FIG. 3 illustrates a block diagram of various components that may be part of the monitoring system 26 and may be used by the monitoring system 26 to perform various analysis operations. As shown in FIG. 3, the monitoring system 26 may include a communication component 52, a processor 54, a memory 56, a storage 58, input/output (I/O) ports 60, a display 62, and the like. The communication component 52 may be a wireless or wired communication component that may facilitate communication between different monitoring systems 26, gateway communication devices, various control systems, and the like. The processor 54 may be any type of computer processor or microprocessor capable of executing computer-executable code. The memory 56 and the storage 58 may be any suitable articles of manufacture that can serve as media to store processor-executable code, data, or the like. These articles of manufacture may represent computer-readable media (i.e., any suitable form of memory or storage) that may store the processor-executable code used by the processor 34 to perform the presently disclosed techniques. The memory 56 and the storage 58 may also be used to store data received via the I/O ports 60, data analyzed by the processor 54, or the like.

The I/O ports 60 may be interfaces that may couple to various types of I/O modules such as sensors, programmable logic controllers (PLC), and other types of equipment. For example, the I/O ports 60 may serve as an interface to pressure sensors, flow sensors, temperature sensors, and the like. As such, the monitoring system 26 may receive data associated with a well via the I/O ports 60. The I/O ports 60 may also serve as an interface to enable the monitoring system 26 to connect and communicate with surface instrumentation, flow meters, water cut meters, multiphase meters, and the like.

In addition to receiving data via the I/O ports 60, the monitoring system 26 may control various devices via the I/O ports 60. For example, the monitoring system 26 may be communicatively coupled to an actuator or motor that may modify the size of a choke that may be part of the well. The choke may control a fluid flow rate of the hydrocarbons being extracted at the well or a downstream system pressure within the network of pipelines 24 or the like. In one embodiment, the choke may be an adjustable choke that may receive commands from the monitoring system 26 to change the fluid flow and pressure parameters at the well.

The display 62 may include any type of electronic display such as a liquid crystal display, a light-emitting-diode display, and the like. As such, data acquired via the I/O ports and/or data analyzed by the processor 54 may be presented on the display 62, such that operators having access to the monitoring system 26 may view the acquired data or analyzed data at the hydrocarbon well site. In certain embodiments, the display 62 may be a touch screen display or any other type of display capable of receiving inputs from the operator.

Figure 4:
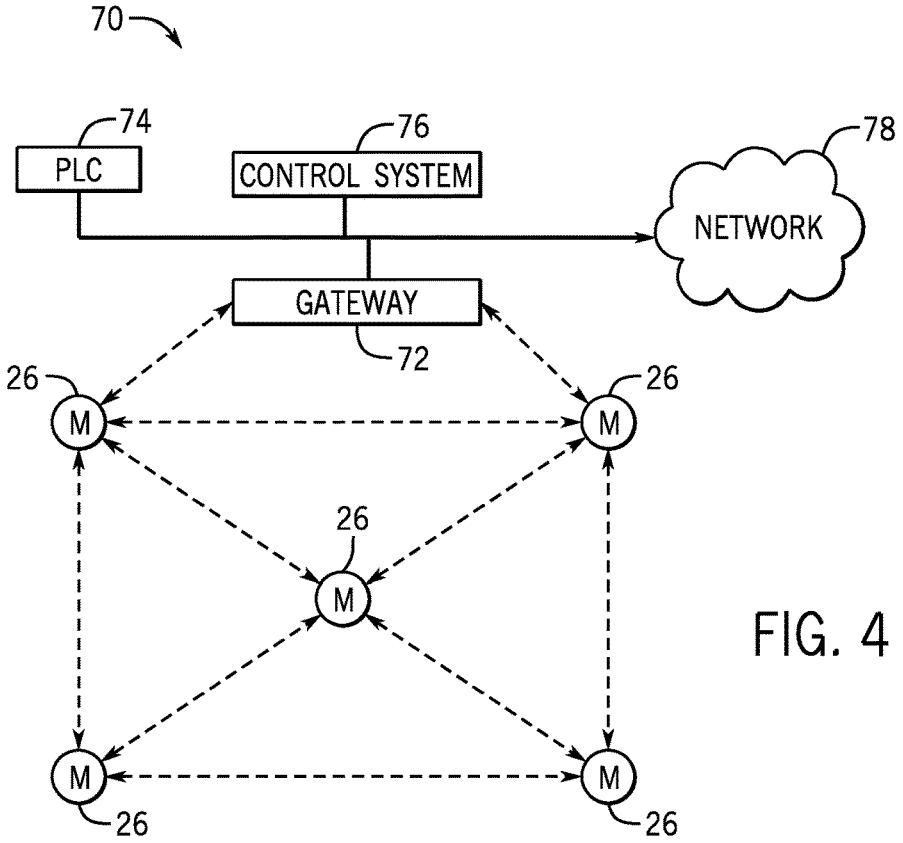
FIG. 4 illustrates a communication network that may be employed in the hydrocarbon site of FIG. 1, in accordance with embodiments presented herein.

Referring back to the communication component 52, the monitoring system 26 may use the communication component 52 to communicatively couple to various devices in the hydrocarbon site 10. FIG. 4, for instance, illustrates an example communication network 70 that may be employed in the hydrocarbon site 10. As shown in FIG. 4, each monitoring system 26 may be communicate with one or more other monitoring systems 26. That is, each monitoring system 26 may communicate with certain monitoring systems 26 that may be located within some range of the respective monitoring system 26. Each monitoring system 26 may communicate with each other via its respective communication component 52. As such, each monitoring system 26 may transfer raw data acquired at its respective location, analyzed data (e.g., multiphase measurements) associated with a respective well, or the like to each other. In one embodiment, the monitoring systems 26 may route the data to a gateway device 72. The gateway device 72 may be a network device that may interface with other networks or devices that may use different communication protocols. As such, the gateway device 72 may include similar components as the monitoring components 26. However, since the gateway device 72 may not be located at the well site or coupled to a well device, the gateway device 72 may have a larger form factor as compared to the monitoring system 26. Additionally, since the gateway device 72 may receive and process data acquired from multiple monitoring systems 26, the gateway device 72 may use a larger battery or power source as compared to the monitoring system 26 to process the additional data. In this manner, the gateway device 72 may also include a larger and/or faster processor 54, a larger memory 56, and a larger storage 58, as compared to the monitoring system 26.

After receiving data from the monitoring systems 26, the gateway device 72 may provide the data from each monitoring system 26 to various types of devices, such as a programmable logic controller (PLC) 74, a control system 76, and the like. The PLC 74 may include a digital computer that may control various components or machines in the hydrocarbon site 10. The control system 76 may include a computer-controlled system that monitors the data received via the monitoring devices 26 and may and control various components in the hydrocarbon site 10 and various processes performed on the extracted hydrocarbons by the components. For example, the control system 76 may be a supervisory control and data acquisition (SCADA), which may control large-scale processes, such as industrial, infrastructure, and facility-based processes, that may include multiple hydrocarbon sites 10 separated by large distances.

The gateway device 22 may also be coupled to a network 78. The network 78 may include any communication network, such as the Internet or the like, that may enable the monitoring systems 26, the gateway 72, the PLC 74, the control system 76, and the like to communicate with other like devices.

As mentioned above, each monitoring system 26 may acquire data from various sensors disposed throughout a respective well, the hydrocarbon well site, and the like. To enable well site personnel (i.e., operators physically located at the well site) to ensure that the well is operating efficiently, the monitoring system 26 may perform some initial data analysis using the processor 54 and may output the results of the data analysis via the display 62. In certain embodiments, the monitoring device 26 may transmit the results of the data analysis to a handheld electronic device (e.g., mobile phone, tablet computer, laptop computer, etc.) via the communication component 52 using a communication protocol, such as Bluetooth® or any other wireless or wired protocol. After receiving the results of the data analysis via the display 62 or the handheld electronic device, the operator may modify various operating parameters of the well based on the results. That is, the operator may interpret the analyzed data (e.g., multiphase measurements) and modify the operating parameters of the well to increase the efficiency at which the well may produce hydrocarbons. In one embodiment, the monitoring system 26 may automatically determine whether the operating parameters of the well are desirable based on the results of the data analysis to achieve a desired efficiency or operating point of the well.

Figure 5:
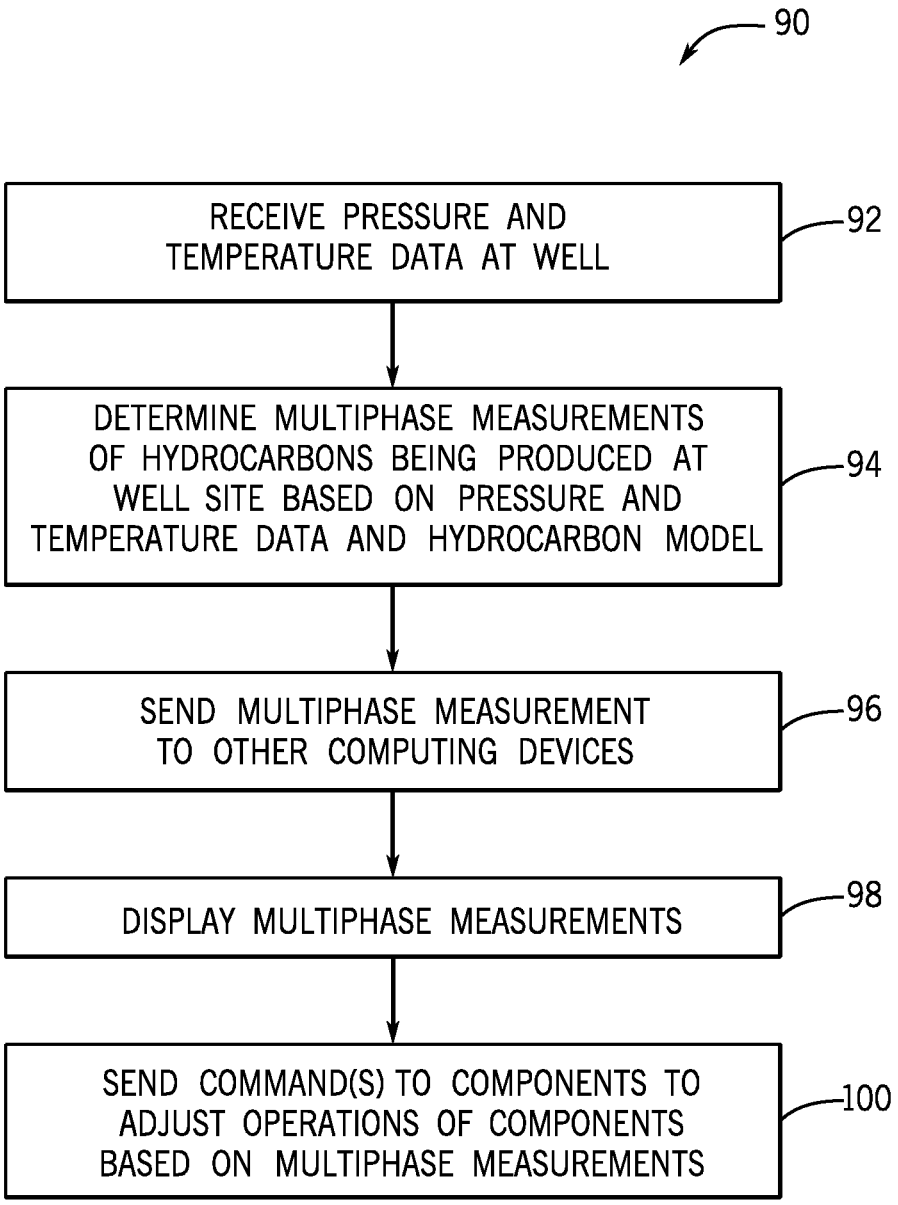
FIG. 5 illustrates a flowchart of a method for determining multiphase measurements of hydrocarbons being produced at the hydrocarbon site of FIG. 1, in accordance with embodiments presented herein.

Keeping this in mind, FIG. 5 illustrates a flowchart of a method 90 that the monitoring system 26 or any suitable computing device may employ for determining multiphase measurements of hydrocarbons being produced at the hydrocarbon site 10. The method 90 may be used for monitoring and/or controlling the operations of natural flowing wells or wells that use artificial lifts to extract hydrocarbons from a reservoir. In either case, since the monitoring system 26 is disposed at the well site, the operations of the well may be monitored, controlled, and operated locally. In this manner, the operations of the well may be optimized or monitored with or without an established communication link to gateway device 72, the PLC 74, the control system 76 (e.g., SCADA), the network 78, or the like. Moreover, since the multiphase measurements of the produced hydrocarbons are determined at the well, an operator at the well may obtain information regarding the multiphase measurements to adjust the operations of the well based on real or near-real time multiphase measurements, thereby improving the efficiency in which the well operates (e.g., produced hydrocarbons).

Although the following description of the method 90 describes a certain procedure, it should be noted that the procedure should not be limited to the order that is depicted in FIG. 5. Instead, it should be understood that the procedure may be performed in any suitable order. Moreover, it should be noted that, in some embodiments, certain portions of the method 90 may not be performed.

Referring now to FIG. 5, at block 92, the monitoring system 26 may receive real-time (or near real-time) data from various sensors disposed throughout the respective well. Generally, the data may include pressure data and temperature data associated with the respective well. As such, the real-time data may include a tubing head pressure, a tubing head temperature, a casing head pressure, a flowline pressure, a wellhead pressure, a wellhead temperature, and the like.

The tubing head pressure may include a pressure measured at or near a location that correspond to where the tubing 40 may meet the surface in a well. In the same manner, the tubing head temperature may include a temperature measured at or near a location that correspond to where the tubing 40 may meet the surface in a well. The casing head pressure may include a pressure measured at or near a location that correspond to where the casing 38 may meet the surface in a well. The flowline pressure may include a pressure measured at or near a large diameter pipe, which may be a section of the casing 38. The large diameter pipe or flowline may be coupled to a mud tank that may receive drilling fluid as it comes out of a borehole. The wellhead pressure may include a pressure measured at or near a location that corresponds to the surface in a well. In this manner, the wellhead temperature may include a temperature measured at or near a location that corresponds to the surface in a well.

At block 94, the monitoring system 26 may determine the multiphase measurements of the hydrocarbons being produced at the well site based on the data received at block 92 and a hydrocarbon model associated with the respective well. In one embodiment, the hydrocarbon model may estimate the multiphase properties of a flow of hydrocarbons (e.g., oil, water, gas, sand) based on physical properties of a region in which the hydrocarbons are being extracted, laboratory analysis performed on sample hydrocarbons extracted from the well, information regarding the well, and the like.

In one embodiment, the hydrocarbon model may be a compilation of data acquired from a number of wells located in a number of different regions. The compilation of data may include multiphase properties of the extracted hydrocarbons extracted from a respective well in a respective region at different pressures and temperatures values at the respective well.

The laboratory analysis performed on the sample of extracted hydrocarbons may include pressure-volume-temperature (PVT) coefficients associated with the extracted hydrocarbon. That is, a sample of the hydrocarbon may be tested in a laboratory or the like by compressing the sample and determining the behavior of the hydrocarbon under various conditions (e.g., pressure and temperature conditions). The results of the tests may be stored in an array or matrix of data that indicates the phase properties of the hydrocarbon sample under various pressure and temperature conditions. The matrix of data may be referred to as base assay coefficients that characterize certain properties (e.g., viscosity, density) of the hydrocarbon sample at various pressure and temperature conditions.

In some instances, a hydrocarbon sample may not be available for testing. As such, the PVT coefficients may not be available for the hydrocarbon model. In this case, the PVT coefficients of a sample may be determined based on a best estimate determined according to the geography of the region in which the sample hydrocarbon would be obtained and known PVT coefficients from other hydrocarbon samples obtained from regions having similar geographical properties as the unavailable hydrocarbon sample. The geographical properties may include information regarding a terrain (e.g., hills) of the region, fluid types of the region, whether the region is onshore or offshore, and the like. In one embodiment, a new assay for the unknown hydrocarbon sample may be determined by adjusting a base assay for a hydrocarbon sample extracted from a similar region as the unknown hydrocarbon sample. The new assay may be determined based on reservoir fluid gas-oil ratios (GOR) and American Petroleum Institute (API) gravity values.

The assay may establish PVT relationships for GOR, liquid and gas densities, mixture density, liquid viscosity, and the like regarding the produced hydrocarbons. The multiphase properties of the extracted hydrocarbons may be determined based on the corresponding assay and pressure and temperature data for each increment of the flow of hydrocarbons.

The hydrocarbon model may also determine the multiphase properties of hydrocarbons being extracted at the respective well based on information regarding the respective well. Information regarding the well may include reservoir characteristics, well type (e.g., natural flow, artificial lift), depth, diameter, type of piping used at the well, and the like. The reservoir characteristics may include information regarding free gas of the reservoir, salinity of the reservoir, static bottom hole pressure of the reservoir, and the like. The reservoir characteristics, in some embodiments, may be determined based on a wireline survey of the reservoir. The wireline survey may provide details regarding the reservoir pressure and salinity of water in the reservoir.

Using the collection of information described above, the hydrocarbon model may determine a flowing bottom hole pressure at the bottom of the well. That is, the hydrocarbon model may perform a nodal analysis of various measurements acquired at the surface of the wellhead to determine the flow properties of the hydrocarbons being produced at different positions (e.g., depths) within the well, and ultimately determine downhole characteristics of the flow of hydrocarbons, the downhole pressure, and the like.

In addition, using the pressure and temperature data acquired at block 92 and the nodal analysis of the hydrocarbon model, the monitoring system 26 may use the hydrocarbon model to determine the multiphase flow characteristics (e.g., percentages of oil, gas, water, and sand) of the hydrocarbons being produced at the bottom hole and at the well head. In other words, the hydrocarbon model may provide real or near-real time analysis of different phases (e.g., oil, water, and gas production) at a well site based on predetermined well characteristics (e.g., well completion data, such as depth, type of pipe; reservoir data, such as free static pressure; and PVT sets/assays from the same or a nearby well), and dynamically measured data, particularly pressure and temperature. In one embodiment, the monitoring system 26 may provide inputs such as pressure, volume, and temperature (PVT) coefficients regarding a sample of hydrocarbon production from the respective well and pressure and temperature data acquired from the well. Using the hydrocarbon model, the monitoring system 26 may then determine a flowing bottom hole pressure at the bottom of the well and the multiphase flow characteristics (e.g., percentages of oil, gas, and water) of the hydrocarbons being produced at the bottom hole and at the well head.

Referring back to the method 90 of FIG. 5, at block 96, the monitoring system 26 may send the multiphase measurements determined at block 94 to other computing devices. The monitoring system 26 may send the measurements using any suitable wired or wireless protocol. In one embodiment, the monitoring system 26 may send the multiphase measurements to other monitoring systems 26 via the communication network 70. As such, operators located at other wells or other components within the hydrocarbon site 10 may receive information regarding the multiphase measurements of the hydrocarbons produced at the respective well.

The other computing devices may also include any suitable tablet computer, laptop computer, mobile computer, or general-purpose computer that may be accessible to the operator. As such, the operator of a well may adjust the operations of various devices within the hydrocarbon site based on the multiphase measurements of the hydrocarbons produced at the respective well.

At block 98, the monitoring system 26 may display the multiphase measurements determined at block 94. As such, the monitoring system 26 may depict values that represent the multiphase measurements on the display 62 or the like. The visualization of the multiphase measurements on the display 26 may provide the operator with information at the physical location of the well to enable the operator to control various equipment (e.g., well tree 16) in the hydrocarbon site 10 to efficiently produce hydrocarbons. For instance, if the multiphase measurements indicate that the water content being produced is greater than a threshold, the operator may decrease a choke size of the well tree 16 to decrease the flow of hydrocarbons until the water content decreases.

In some embodiments, instead of waiting for the operator to make adjustments to the operations of certain equipment, at block 100, the monitoring system 26 may send one or more commands to components disposed in the hydrocarbon site 10 based on the multiphase measurements. For example, the send commands to the pumpjacks 12, submersible pumps 14, well trees 16, a choke, or some other device coupled to the network of pipelines 24 to adjust their respective operations (e.g., speed, diameter) to ensure that the flow of hydrocarbons is optimized to produce a content of oil that is greater than some threshold with respect to the other phases in the extracted hydrocarbons. When sending commands to components in the hydrocarbon site 10, the monitoring system 26 may send commands to electronic devices (e.g., controller, computing systems) that control the operations of the respective component. As such, the electronic device may include a communication component similar to the communication component 52 described above.

By providing the logic to determine the multiphase measurements at the wellhead at real-time or near real-time, the timing/reaction to various issues may improve because detection and control are local (quicker response). Moreover, since the multiphase measurements may be acquired at the wellhead in real time, an operator may react to different conditions in real time to optimize the production of hydrocarbons.

In addition to determining the multiphase measurements of the hydrocarbons being produced at a well, the monitoring system 26 may also generate an alarm notification when a portion of the hydrocarbons includes more than a threshold for the respective portion. For instance, water cut represent a percentage of the produced hydrocarbons that is composed of water. For example, 70% water cut would indicate that of 100 barrels of produced water, 70 barrels would be composed of just water. Generally, the hydrocarbon model uses a water cut value as an input into the model. Typically, although the black oil model determines the multiphase properties of the produced hydrocarbons, the hydrocarbon model uses an initial water cut value as an input for the model to predict the real time multiphase values. The initial water cut value may be determined based on a well test. Well tests may be performed at regular intervals, such as every 30 days. During a well test, the produced hydrocarbons are separated using the separator 20 and the multiphase properties of the produced hydrocarbons may then be determined.

As reservoir water cut changes due to a water interruption, breakthrough, coning, or the like, the water cut associated with the produced hydrocarbons also change. Additionally, as the water cut value of the produced hydrocarbons change, the accuracy of the results of the hydrocarbon model also change. As such, in one embodiment, the monitoring system 26 may include logic to make an early determination or detection of a change in water cut of the produced hydrocarbons. For instance, the logic may monitor the profile of the pressure and/or temperature being measured at the well head and determine a trend of the pressure. If the trend or change in pressure shifts suddenly or the trend of pressure indicates that the pressure will enter the boundary of the assay coefficients of the hydrocarbon model, the logic may determine that a water cut problem has been detected. This detection of increased water cut may enable operators to realize that the other outputs provided by the hydrocarbon model may have a reduced confidence level. Alternatively, the detection of increase water cut may enable an operator of the well or the monitoring system 26 to adjust the operations of various components within the hydrocarbon site 10 to accommodate the increased water cut situation.

Figure 6:
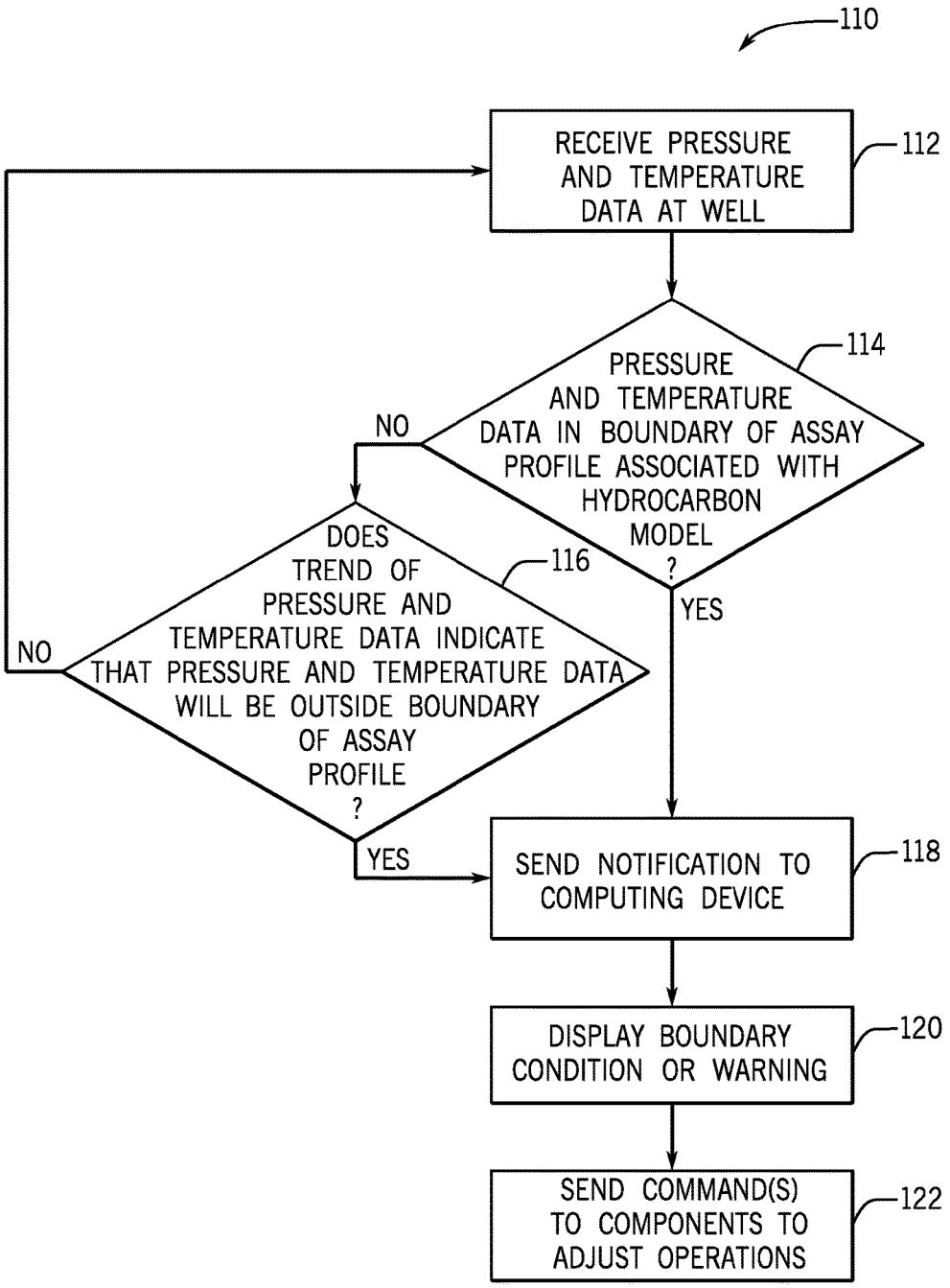
FIG. 6 illustrates a flow chart of a method for adjusting operations of a component in the hydrocarbon site of FIG. 1 based on pressure and/or temperature data at a respective well, in accordance with an embodiment.

With the foregoing in mind, FIG. 6 illustrates a flow chart of a method 110 that may be employed by the monitoring system 26 or any suitable computing device for adjusting operations of component in the hydrocarbon site 10 based on pressure and/or temperature data at the well. The method 110 may be used for monitoring and/or controlling the operations of natural flowing wells or wells that use artificial lifts to extract hydrocarbons from a reservoir. In either case, since the monitoring system 26 is disposed at the well site, the operations of the well may be monitored, controlled, and operated locally. In this manner, the operations of the well may be optimized or monitored with or without an established communication link to gateway device 72, the PLC 74, the control system 76 (e.g., SCADA), the network 78, or the like.

As mentioned above with regard to FIG. 5, although the following description of the method 110 describes a certain procedure, it should be noted that the procedure should not be limited to the order that is depicted in FIG. 6. Instead, it should be understood that the procedure may be performed in any suitable order. Moreover, it should be noted that, in some embodiments, certain portions of the method 110 may not be performed.

Referring now to FIG. 6, at block 112, the monitoring system 26 may receive real-time (or near real-time) data from various sensors disposed throughout the respective well, as described above with respect to block 92 of FIG. 5. Generally, the data may include pressure data and temperature data associated with the respective well. As such, the real-time data may include a tubing head pressure, a tubing head temperature, a casing head pressure, a flowline pressure, a wellhead pressure, a wellhead temperature, and the like.

At block 114, the monitoring system 26 may determine whether the pressure or temperature data received at block 112 correspond to boundaries of an assay profile associated with the respective well in which hydrocarbons are being extracted. The assay profile may include the matrix of data that indicates the phase properties of a hydrocarbon sample that is associated with the hydrocarbons being extracted from the well under various pressure and temperature conditions. In certain embodiments, the assay profile may indicate the phase properties of a hydrocarbon sample within a range of pressure and temperature values. The boundaries of the assay profile may include a certain portion (e.g., percentage) of the assay profile at the beginning or the end of the entire assay profile. For example, the boundaries of the assay profile may be characterized as a first percentage (e.g., 0-5%) of the assay profile and a last percentage (95-100%) of the assay profile. When evaluating whether the pressure and/or temperature data is in the boundary of the assay profile, the monitoring system 26 may track the pressure and/or temperature data with respect to the assay profile and determine whether the pressure and/or temperature data corresponds to some portion of the assay profile located at the beginning or the end of the profile.

If the pressure and/or temperature data does not correspond to the boundary of the assay profile, the monitoring system 26 may proceed to block 116 and determine whether the trend of the pressure and/or temperature data within the boundary of the assay profile or outside the boundary of the assay profile within a certain amount of time. As such, the monitoring system 26 may track how the pressure and/or temperature data changes over time and predict whether the pressure and/or temperature data may be within the boundaries of the assay profile or outside the boundaries of the assay profile based on the trend continuing over time. If the monitoring system 26 determines that the trend of the pressure and/or temperature data will not be within the boundary regions or outside the boundaries of the assay profile, the monitoring system 26 may return to block 112 and perform the method 110 again.

If, however, the monitoring system 26 determines the trend of the pressure and/or temperature data does indicate that the pressure and/or temperature data will be within the boundary regions or outside the boundaries of the assay profile within a certain amount of time, the monitoring system 26 may proceed to block 118. Referring back to block 114, if the monitoring system 114 determines that the pressure and/or temperature data 114 is within the boundary regions of the assay profile, the monitoring system 26 may also proceed to block 118.

At block 118, the measurement system 26 may send a notification to other computing devices. The notification may include an alarm indicating that the water cut or portion of the water of the hydrocarbons being produced at the well is above some threshold. The notification may be transmitted to other computing devices similarly as described above with reference to block 96 of FIG. 5.

Additionally, the monitoring system 26 may display the boundary condition detected by the monitoring system 26 on the display 26 similar to the block 98 of FIG. 5. As such, the operator of the well may perform certain actions in real time or near-real time based on information available at the well.

In the same manner, in some embodiments, at block 122, the monitoring system 26 may send one or more commands to certain components within the hydrocarbon site 10 to adjust their respective operations based on the notification. As such, the monitoring system 26 may send commands to components in a similar fashion as described above with reference to block 100 of FIG. 5.

Although the above description of the method 110 has been described with reference to a water cut notification, it should be noted that in addition to monitoring the water cut of the flow of hydrocarbons, the monitoring system 26 may also monitor gas volume fraction and a productivity index of the flow of hydrocarbons using the same principles described above. The gas volume fraction may indicate an amount of gas in the flow of hydrocarbons. The productivity index may represent a ratio of flow of the hydrocarbons (e.g., barrels per day) to draw down pressure. Moreover, the updated water cut, gas volume fraction, and production index information may, in one embodiment, be input back into the hydrocarbon model to provide more accurate results with regard tot eh multiphase measurements determined by the hydrocarbon model.

In addition to determining the multiphase measurements of the flow of hydrocarbons, the monitoring system 26 may receive flow line pressure data associated with a choke that may be part of the network of pipelines 24. In one embodiment, the choke may be associated with or in line with the production of hydrocarbons at the respective well. The flow line pressure after the choke may include the pressure within the pipe after the choke while the hydrocarbons are flowing. Based on the multiphase measurements and the flow line pressure data and manufacturing specifications regarding the choke, the monitoring system 26 may determine an amount of time before the choke may wear out or should be serviced. In one embodiment, if the monitoring system 26 determines that the choke may wear out within some amount of time, the monitoring system 26 may send a signal to the choke to adjust its opening to adjust the flow line pressure and elongate the amount of time until wear out.

Using the same information regarding the multiphase measurements and the flow line pressure, the monitoring system 26 may determine whether a bottleneck condition is present at the choke. If the bottleneck condition is present or may be present within some amount of time, the monitoring system 26 may send a signal to the choke to open or adjust its position to relieve the bottleneck pressure.

Figure 7:
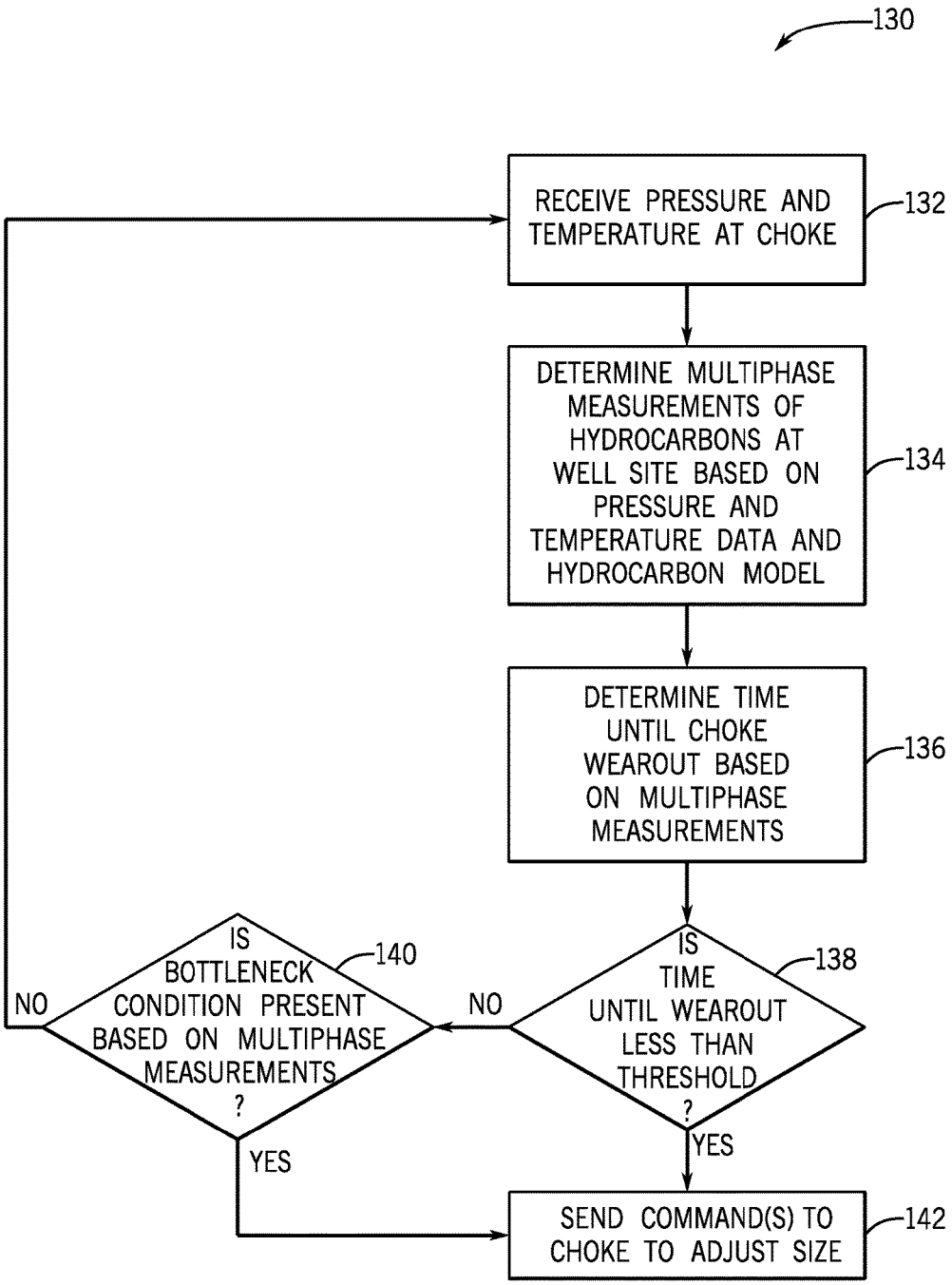
FIG. 7 illustrates a flow chart of a method for adjusting certain properties of a choke based on the multiphase measurements of the hydrocarbons being produced at a well.

Keeping this in mind, FIG. 7 illustrates flow chart of a method 130 for adjusting certain properties of a choke based on the multiphase measurements of the hydrocarbons being produced at a well. The method 130 may be used for monitoring and/or controlling the operations of chokes associated with natural flowing wells or wells that use artificial lifts to extract hydrocarbons from a reservoir. In either case, since the monitoring system 26 is disposed at the well site, the operations of the well may be monitored, controlled, and operated locally. In this manner, the operations of the well may be optimized or monitored with or without an established communication link to gateway device 72, the PLC 74, the control system 76 (e.g., SCADA), the network 78, or the like.

As mentioned above with regard to FIGS. 5 and 6, although the following description of the method 130 describes a certain procedure, it should be noted that the procedure should not be limited to the order that is depicted in FIG. 7. Instead, it should be understood that the procedure may be performed in any suitable order. Moreover, it should be noted that, in some embodiments, certain portions of the method 130 may not be performed.

Referring now to FIG. 7, at block 132, the monitoring system 26 may receive pressure and temperature data from sensors disposed at or near a choke coupled inline with a respective well. The sensors may include the sensors described above with reference to block 95 of FIG. 5 and may measure flow line pressure after a choke or pressure within the pipe after the choke while the hydrocarbons are flowing. At block 134, the monitoring system 26 may determine the multiphase measurements of hydrocarbons being produced at the well in a similar manner as described above with reference to block 94.

Based on the multiphase measurements determined at block 134, the monitoring system 26 may determine an amount of time until a choke in line with the respective well may wear out or may be serviced. In one embodiment, the monitoring system 26 may receive information regarding the operating parameters of the choke. For example, the monitoring system 26 may have access to an expected amount flow of hydrocarbons for a lifetime of the choke. Additionally, the monitoring system 26 may have access to empirical data regarding similar chokes or chokes manufactured by the same manufacturer and their respective operations and lifecycles. Using this collection of information and the multiphase measurements, the monitoring system 26 may determine an amount of wear being placed on the choke over time. In certain embodiments, the choke may be designed to accommodate hydrocarbons having certain portions of each phase. However, if a particular phase (e.g., sand) is above some threshold, the choke may wear more quickly.

In any case, at block 138, the monitoring system may determine whether the amount of time until wear out or service determined at block 136 is greater than some threshold. If the amount of time is not greater than the threshold, the monitoring system 26 may proceed to block 140.

If, however, the amount of time is greater than the threshold, the monitoring system 26 may proceed to block 142. At block 142, the monitoring system 26 may send a command to a control system or electronic device that may control the operation of the choke. The command may cause the choke to adjust its size, such that the amount of time until wear out or service increases. As such, the choke may In some embodiments, the monitoring system 26 may also send a notification regarding the amount of time to other computing devices as described above with reference to bock 96 of FIG. 5, display a notification regarding the amount of time on the display 62 as described above with reference to bock 98 of FIG. 5, or the like.

As mentioned above, if the amount of time is not greater than the threshold at block 138, the monitoring system 26 may proceed to block 140. At block 140, the monitoring system 26 may determine whether a bottleneck condition is present on the choke based on the multiphase measurements determined at block 134. In one embodiment, the choke may be designed to accommodate a flow of hydrocarbons having a certain proportions of each phase. However, if one phase (e.g., sand) exceeds a threshold, the choke may not efficiently allow the hydrocarbons to flow passed the choke. Moreover, based on the multiphase measurements and the flow line pressure at the choke received at block 132, the monitoring system 26 may determine whether a bottleneck condition is present at the choke.

The bottleneck condition may correspond to a situation where components downstream from the choke such as the separator 20 or the like may be capable of processing a higher flow of hydrocarbons than it is currently receiving via the choke. In this case, the monitoring system 26 may proceed to block 142 and send a command to the choke to adjust its size (e.g., increase) to prevent the choke from impeding the efficiency of the operations at the hydrocarbon site. In addition to sending commands to the choke, in some embodiments, the monitoring system 26 may also send a notification regarding the bottleneck condition to other computing devices as described above with reference to bock 96 of FIG. 5, display a notification regarding the bottleneck on the display 62 as described above with reference to bock 98 of FIG. 5, or the like.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A system, comprising:

a monitoring device configured to receive data associated with one or more properties of a well configured to produce a flow of hydrocarbons, wherein the monitoring device is configured to:

determine that the flow of hydrocarbons comprises a percentage of water greater than a threshold based on the data being outside an assay profile associated with the flow of hydrocarbons at the well over time, wherein the assay profile comprises a matrix of data that indicates one or more phase properties of a hydrocarbon sample that is associated with the flow of hydrocarbons being extracted from the well under one or more pressure and temperature conditions;

send an alarm notification to another device indicating an increased water cut in the flow of hydrocarbon;

determine that the flow of hydrocarbons is associated with a productivity index greater than a second threshold based on the data being outside the assay profile associated with the flow of hydrocarbons at the well over time, wherein the productivity index is representative of a ratio of the flow of hydrocarbons to a drawdown pressure; and send a second alarm notification to the other device indicating an increased productivity index in the flow of hydrocarbons.

2. The system of claim 1, wherein the monitoring device is configured to:

determine that the flow of hydrocarbons comprises a percentage of gas volume greater than a third threshold based on the data being outside the assay profile associated with the flow of hydrocarbons at the well over time; and send a third alarm notification to the other device indicating an increased gas volume in the flow of hydrocarbon.

3. The system of claim 1, wherein the threshold corresponds to a boundary region of the assay profile.

4. The system of claim 3, wherein the boundary region comprises 0-5% of the assay profile or 95-100% of the assay profile.

5. The system of claim 1, comprising a display configured to display the alarm notification.

6. A method, comprising:

receiving, via a processor, data associated with one or more properties of a well configured to produce a flow of hydrocarbons;

determining that the flow of hydrocarbons comprises a percentage of water greater than a threshold based on the data being outside an assay profile associated with the flow of hydrocarbons at the well over time, wherein the assay profile comprises a matrix of data that indicates one or more phase properties of a hydrocarbon sample that is associated with the flow of hydrocarbons being extracted from the well under one or more pressure and temperature conditions;

sending an alarm notification to another device indicating an increased water cut in the flow of hydrocarbon;

determining that the flow of hydrocarbons is associated with a productivity index greater than a second threshold based on the data being outside the assay profile associated with the flow of hydrocarbons at the well over time, wherein the productivity index is representative of a ratio of the flow of hydrocarbons to a drawdown pressure; and sending a second alarm notification to the other device indicating an increased productivity index in the flow of hydrocarbon.

7. The method of claim 6, comprising:

determining that the flow of hydrocarbons comprises a percentage of gas volume greater than a third threshold based on the data being outside the assay profile associated with the flow of hydrocarbons at the well over time; and sending a third alarm notification to the other device indicating an increased gas volume in the flow of hydrocarbon.

8. The method of claim 6, wherein the threshold corresponds to a boundary region of the assay profile.

9. The method of claim 8, wherein the boundary region comprises 0-5% of the assay profile or 95-100% of the assay profile.

* * * * *